United States Patent [19]

Kothman

[11] Patent Number: 5,040,924

[45] Date of Patent: Aug. 20, 1991

[54] CONCEALABLE ANCHOR

[76] Inventor: Sheldon B. Kothman, 3362 Brownlow Ave. South, St. Louis Park, Minn. 55426

[21] Appl. No.: 527,884

[22] Filed: May 24, 1990

[51] Int. Cl.[5] ..... E02D 5/54; E02D 5/74

[52] U.S. Cl. ..... 405/244; 52/155; 248/499

[58] Field of Search ..... 405/231, 244, 259; 52/155, 156, 165; 114/230, 294; 119/122, 125; 244/115; 248/499

[56] References Cited

U.S. PATENT DOCUMENTS

| | | | |
|---|---|---|---|
| 77,686 | 5/1868 | Walther . | |
| 224,083 | 2/1880 | Furman . | |
| 364,175 | 5/1887 | Hurd . | |
| 519,891 | 5/1894 | Muth . | |
| 543,624 | 7/1895 | Hanson . | |
| 581,065 | 4/1897 | Conner | 119/125 |
| 631,168 | 8/1899 | Langston | 52/155 |
| 775,518 | 11/1904 | Bruley . | |
| 883,782 | 4/1908 | Butcher | 119/125 |
| 1,087,567 | 2/1914 | Bartosz . | |
| 1,640,504 | 8/1927 | Isaacs . | |
| 2,713,327 | 7/1955 | West . | |
| 3,494,587 | 2/1970 | Kuhn | 248/499 |

*Primary Examiner*—David H. Corbin

*Attorney, Agent, or Firm*—Schroeder & Siegfried

[57] ABSTRACT

A concealable anchor which can be buried or cemented in the ground such that the top end thereof is flush with ground level, wherein the anchor has an elongated tubular pipe which is open on both its top and bottom ends, and an attachment chain fixedly connected at one end to the exterior surface of the bottom end portion of the tubular pipe. The chain extends through the opening in the bottom end of the tubular pipe into the inner confines thereof. The other end of the chain is connected to a removable end cap which seats upon and covers the open top end of the tubular pipe. The attachment chain is of sufficient length such that it may be pulled outwardly from within the pipe through the open top end thereof for attachment of an object thereto, when desired. The attachment chain is constructed such that it may also retract into smaller compass for storage within the tubular pipe when the anchor is not in use.

20 Claims, 1 Drawing Sheet

CONCEALABLE ANCHOR

BACKGROUND OF THE INVENTION

My invention is generally related to anchors, and more particularly to a heavy duty rigid concealable anchor for use in anchoring objects to the ground, such as airplanes, boats, trailers, and other vehicles or objects which a person desires to keep under lock and key.

In order to avoid theft of such items as airplanes, trailers and other vehicles, often large cumbersome anchors which rest external to the ground are used to secure and connect to such objects via a chain. In the past, airlines have used old tires filled with concrete as a means for anchoring airplanes to the runways. Such anchors which are external to the ground take up much space and must frequently be moved out of the way so as not to block and obstruct the path of airplanes or other vehicles.

It is evident that there is a distinct need for a means of anchoring such objects to the ground which is rigid and capable of being concealed so as not to block or cause obstruction of vehicles, or occupy other needed space above ground. Such an anchor must be rigidly secured underground so as not to be capable of being pulled therefrom, and must provide an attachment means which can be pulled from the ground when use thereof is desired, and yet retractable and concealable underground when the anchor is not being used.

My invention provides such a concealable anchoring means which is specifically designed to be concealable underground and to be fixedly secured therewithin. My concealable anchor is rigid and designed such that it will be fixedly secured underground, and with minimal parts and labor, can be manufactured and provide an effective means for anchoring any of a variety of objects which a person desires to keep under lock and key.

BRIEF SUMMARY OF THE INVENTION

My invention is comprised generally of an elongated, rigid tubular member, preferably made of a metallic material, which is open at both ends so as to effectively allow ground water and moisture to seep therethrough and to prevent premature corrosion of the walls of the tubular pipe. Connected to the external surface of the tubular pipe at a point adjacent the lower end thereof is one end of a rigid chain which extends therefrom into the pipe through the opening in the bottom end thereof to its other end where it attaches to an end cap. The end cap is constructed to seat and cover the open top end of the pipe.

The tubular pipe is designed to be buried underground with the open top end being substantially flush with ground level. The attachment chain is welded (or fixedly secured by some other suitable means) to the exterior surface of the tubular pipe, and provides an anchoring means for the pipe once it is buried or cemented into the ground. The outward protrusion of the chain from the tubular pipe prevents the pipe from being pulled upwardly out of the ground.

When the concealable anchor is not in use, the chain rests in a retracted position within the confines of the buried tubular pipe. In such a condition, the end cap covers the top end of the pipe so as to prevent water from entering same. When it is desired to use the anchoring device, the end cap can be grasped and lifted, thereby pulling the chain from within the tubular pipe through its open top end. It is evident from the construction of my concealable anchor that it is necessary for the length of the chain to be longer than the length of the elongated tubular pipe which is buried underground. As such, the chain is capable of and is designed such that it will retract into smaller compass for storage thereof within the confines of the tubular pipe when not in use. Also, it is evident that the tubular pipe must have inner dimensions which facilitate and allow the attachment chain to retract into its unused position therewithin.

DETAILED DESCRIPTION OF THE INVENTION

Figure 1:
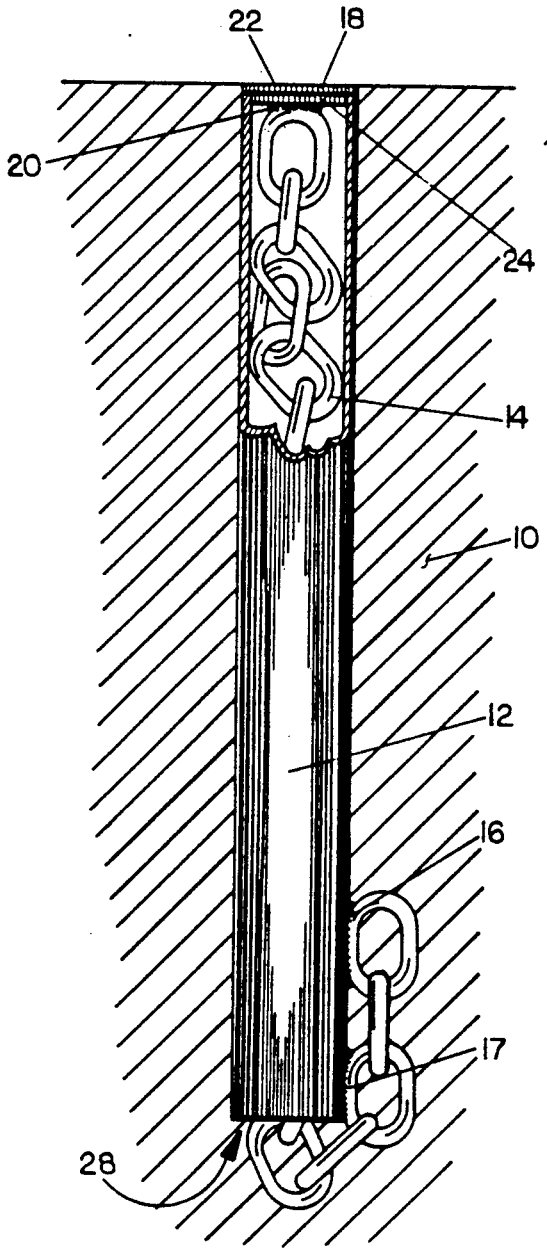
FIG. 1, is a side elevational view of my new concealable anchor buried under ground with the top portion thereof broken away to show the attachment chain 14 resting in its retracted position within the confines of the tubular member.

My new concealable anchor 10 is shown in FIG. 1 in its unused resting position. My new concealable anchor 10 is generally comprised of a rigid elongated open-ended tubular member 12, which is preferably made of a metallic material, and an attachment chain 14 which is fixedly connected by means of weld 16 (or fixedly secured by some other suitable means) to the exterior surface of the lower portion of tubular member 12, which is buried underground The attachment chain 14 extends upwardly through tubular member 12 and connects at its upper end to a removable cap 18 by means of another weld 20 or other suitable attachment means.

As shown in FIG. 1, when my new concealable anchor is not in use, the chain rests in a retracted position within the confines of the tubular member 12. The geometric configuration of each chain link and the inner dimensions of tubular member 12 provide ample space for the chain 14 to retract into smaller compass for storage within tubular member 12 when the concealable anchor 10 is not in use.

The attachment chain 14 is fixedly secured to the outer confines of the tubular member 12, which is buried underground. Consequently, the portion of chain 14 which is fixedly connected to the exterior of tubular member 12 acts as an added anchoring means to help prevent tubular member 12 from being pulled out of the ground by a large force. Any pulling force exerted on chain 14 is directed to the bottom of tubular member 12, thereby transmitting the pulling force into the structure of tubular member 12.

As shown in FIG. 1, the top end of chain 14 is fixedly connected to cap 18 via weld 20. When not in use, the weight of chain 14 causes cap 18 to seat on the top of tubular member 12 and cover the same so that moisture does not seep therethrough. Cap 18 is comprised generally of an upper and lower flat disk, 22 and 24, respectively, which are welded together to form the cap. The upper disk 22 has a diameter substantially equal to the outer diameter of tubular member 12. The lower disk 24, which connects to chain 14 via weld 20, has a diameter only slightly less than the inner diameter of tubular member 12. Consequently, when cap 18 seats on the top of tubular member 12, the lower disk 24 extends into the top opening 26 in tubular member 12. The lower disk 24 of cap 18 provides proper alignment of cap 18 so that the same seats properly and covers on the top of tubular member 12. When cap 18 is properly seated, my concealable anchor is designed to rest substantially flush with ground level.

Figure 2:
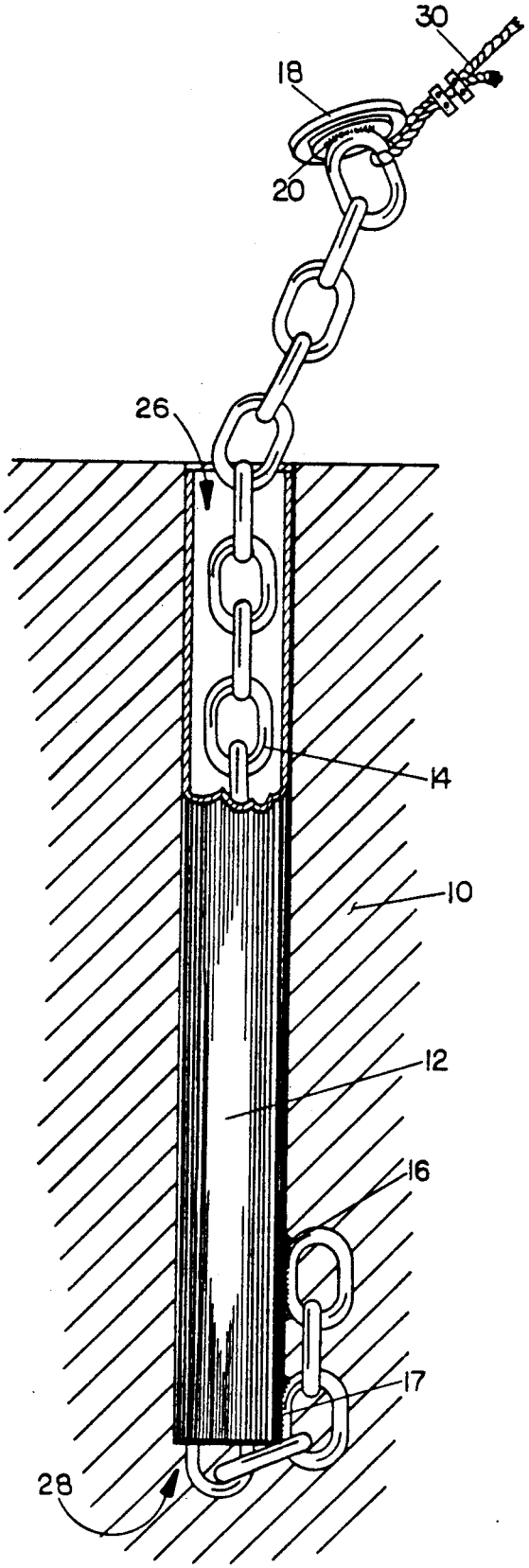
FIG. 2, is a side elevational view of my new concealable anchor in use, with the top portion thereof broken away to show the atachment chain in its fully extended position.

As shown in FIG. 2, attachment chain 14, in its fully extended position, is necessarily longer than the length of the tubular member 12. The attachment chain 14 is fixedly connected to the lower exterior portion of tubular member 12 and extends upwardly through the bottom opening 28 in tubular member 12 and out through the top opening 26 therein, for attachment to a suitable connector 30, such as a cable, rope or chain.

Tubular member 12 is constructed with open top and bottom ends, 26 and 28 respectively, so as to allow ground water and moisture to seep therethrough and prevent premature corrosion of the walls of the tubular member 12. The unique design of my new concealable anchor 10 is rigid and heavy duty, yet inexpensive to manufacture. It is particularly designed with enough strength and rigidity so as to anchor such objects as airplanes, boats, trailers and other vehicles or objects of large structure. However, it is readily apparent that other objects which a person desires to keep under lock and key may also be attached to my concealable anchor 10.

In considering this invention, it should be remembered that the present disclosure is illustrative only and the scope of the invention should be determined by the appended claims.

What is claimed is:

1. A concealable anchor for insertion with the ground, comprising:

(a) an elongated rigid tubular member having open top and bottom ends, said tubular member being constructed and arranged to be buried underground with the top end thereof being disposed substantially flush with ground level;

(b) an attachment chain having ends, one said chain end being fixedly connected to the exterior portion of said tubular member at a point intermediate said top and bottom ends thereof and extending upwardly through said tubular member, said chain having a length which is longer than the length of said tubular member; and (c) a cap fixedly connected to said other end of said chain and being constructed and arranged to removably cover said open top end of said tubular member.

2. The structure defined in claim 1, wherein said tubular member is constructed with inner dimensions sufficient in size to facilitate retraction of said chain into small compass for storage of said chain within said tubular member.

3. The structure defined in claim 1, wherein said chain is constructed and arranged to retract into relatively small compass for storage thereof with the confines of said tubular member.

4. The structure defined in claim 1, wherein said tubular member is constructed of a rigid metallic corrosion resistant material.

5. A concealable anchor which can be buried underground so as to be flush with ground level, comprising:

(a) an elongated rigid tubular member having open top and bottom ends with a cylindrical wall extending therebetween, said tubular member being constructed and arranged to be buried underground with said open top end thereof substantially flush with ground level;

(b) an attachment means fixedly connected directly to said wall of said tubular member and extending upwardly therewithin, said attachment means being constructed and arranged to be capable of retracting into small compass for storage within said tubular member and capable of extending outwardly through said open top end of said tubular member when anchoring thereto is desired, said attachment means being further constructed and arranged to anchor said tubular member within the ground; and (c) means connected to said attachment means for grasping and pulling said attachment means from within said tubular member outwardly through said open top end thereof.

6. The structure defined in claim 5, wherein said tubular member has inner dimensions which facilitate easy retraction of said attachment means into smaller compass within the confines of said tubular member.

7. The structure defined in claim 5, wherein said attachment means is a chain with ends, one of said chain ends being fixedly connected to said wall of said tubular member, and said other chain end being connected to said means for grasping said attachment means.

8. The structure defined in claim 5, wherein said attachment means is connected to the exterior of said wall and extends upwardly into said tubular member through said open bottom end thereof.

9. The structure defined in claim 5, wherein said attachment means is longer than the length of said tubular member.

10. The structure defined in claim 9, wherein said attachment means is a rigid chain which is connected at one end to the exterior of said wall of said tubular member adjacent said bottom end thereof.

11. The structure defined in claim 5, wherein said means for grasping said attachment means is comprised of a removable end cap which is constructed and arranged to seat on said open top end of said tubular member and to cover same when the anchor is not in use.

12. The structure defined in claim 11, wherein said end cap has a depending portion which is constructed and arranged for cooperative telescopic engagement within the inner confines of said tubular member.

13. A concealable anchoring apparatus to be buried flush with ground level, comprising:

(a) an elongated rigid tubular member having open top and bottom ends;

(b) an attachment means being positively connected to said tubular member and disposed substantially therewithin, said attachment means being of longer length than said tubular member, and said attachment means being constructed and arranged to provide a means for anchoring said tubular member within the ground after it is buried therein; and (c) a means for grasping and pulling said attachment means from within said tubular member through said open top end thereof.

14. The structure defined in claim 13, wherein said attachment means is comprised of a chain fixedly connected at one end to said tubular member adjacent the bottom end thereof.

15. The structure defined in claim 14, wherein said bottom end of said tubular member is open and said chain is connected to the exterior surface of said tubular member, said chain extending upwardly through said open bottom end of said tubular member into the interior confines thereof.

16. The structure defined in claim 13, wherein said means for grasping and pulling said attachment means is comprised of an end cap which is constructed and arranged to cover said open top end of said tubular member when the anchor is not in use.

17. The structure defined in claim 13, wherein said attachment means is constructed and arranged to be capable of retracting into smaller compass for storage within said tubular member, and capable of being extended outwardly beyond said open top end for attachment of an object thereto, if desired.

18. The structure defined in claim 13, wherein said attachment means is fixedly connected at one end to the exterior surface of said tubular member.

19. The structure defined in claim 13, wherein the majority of said attachment means always remains within the confines of said tubular member.

20. The structure defined in claim 13, wherein said tubular member has inner dimensions sufficiently large so as to allow said attachment means to retract entirely therewithin when the anchor is not in use.

* * * * *